US006828990B2

(12) United States Patent
Krolczyk et al.

(10) Patent No.: US 6,828,990 B2
(45) Date of Patent: Dec. 7, 2004

(54) SYSTEM FOR PROCESSING TABBED PAGES IN THE DOCUMENT

(75) Inventors: Marc J. Krolczyk, Rochester, NY (US); Thomas J. Perry, Pittsford, NY (US); Edward W. Dyer, Somerville, MA (US)

(73) Assignee: Xerox Corporation, Stamford, CT (US)

( * ) Notice: Subject to any disclaimer, the term of this patent is extended or adjusted under 35 U.S.C. 154(b) by 492 days.

(21) Appl. No.: 09/750,429

(22) Filed: Dec. 28, 2000

(65) Prior Publication Data

US 2002/0085040 A1 Jul. 4, 2002

(51) Int. Cl.[7] ..... G09G 5/00

(52) U.S. Cl. ..... 345/777; 345/776; 345/780; 345/810

(58) Field of Search ..... 715/776, 777, 715/783, 855, 810, 841

(56) References Cited

U.S. PATENT DOCUMENTS 5,337,161 A * 8/1994 Hube ..... 358/448
5,745,718 A * 4/1998 Cline et al. ..... 345/777
6,452,609 B1 * 9/2002 Katinsky et al. ..... 345/716
6,544,295 B1 * 4/2003 Bodnar ..... 709/219
6,549,300 B2 * 4/2003 Motamed et al. ..... 358/1.18
6,571,054 B1 * 5/2003 Tonomura et al. ..... 386/95
6,616,702 B1 * 9/2003 Tonkin ..... 715/515

* cited by examiner

*Primary Examiner*—Ba Huynh
*Assistant Examiner*—Nhon (Gary) D Nguyen
(74) *Attorney, Agent, or Firm*—Fay, Sharpe, Fagan, Minnich & McKee, LLP

(57) ABSTRACT

The user interface is provided to aid a user in preparation of a document having precut tabbed pages. The user interface allows tab content, including monochrome or color text and graphics, to be automatically positioned on the tabs of the precut tabbed pages. The user may enter all the tab content information at one time or, alternatively, may enter tab information during processing of the document. The user interface further provides the ability to view a graphical representation of the arranged precut tabbed pages with the appropriate tab content.

17 Claims, 4 Drawing Sheets

SYSTEM FOR PROCESSING TABBED PAGES IN THE DOCUMENT

FIELD OF THE INVENTION

The invention relates generally to management of document processing and specifically to the creation and management of tabbed pages in documents.

BACKGROUND OF THE INVENTION

Document processing has come to include a wide variety of features and technologies. Commonly, the features and technologies are provided within a single piece of equipment. For example, printers and copiers can now collate and bind multiple copies of documents. Binding options can include stapling, hot glue or other forms of binding involving various plastic components such as comb binding. Furthermore, covers may be placed on the front and back of documents, and frequently the covers are thicker paper and/or colored paper, differing from the remaining portions of the document.

Large documents are frequently divided into multiple sections. It is commonly desired to demarcate each section from neighboring sections. Typically, this is accomplished by the use of a tabbed page, having a dimension differing from most of the pages within the document. Preferably, the tabs are provided with additional text or graphics so as to indicate the corresponding section merely by inspection of the tab.

A need exists within the art to improve and automate the insertion of tabbed pages within a document and to provide for tab content to be located on the tabs of the tabbed pages within the document in a neat, consistent and orderly manner.

SUMMARY OF THE INVENTION

The present invention addresses these needs for automation within the art. According to one embodiment of the invention, a user interface for creating and managing tabbed pages is provided, having a tab data entry frame facilitating entry of tab data and entry of tab content and a page preview frame showing a tab layout and said tab content.

According to another embodiment of the invention, a document processing system is provided including both a user interface and an output device.

According to another embodiment of the invention, a method for processing a document having tabbed pages is provided, wherein tab modulus data is received, a location of a tab is determined, tab content is received and tab content is positioned on the tab.

BRIEF DESCRIPTION OF THE DRAWINGS

The foregoing and other objects, features and advantages of the invention will be apparent from the following description and apparent from the accompanying drawings, in which like reference characters refer to the same parts throughout the different views. The drawings illustrate principles of the invention and are not to scale.

DETAILED DESCRIPTION OF THE INVENTION

The invention allows for the automated processing of documents having tabbed pages. A user interface is provided for entry of tab data and tab content information from a user, while providing the ability to display graphical representations of the tabbed pages resulting from the information entered by the user.

Figure 1:
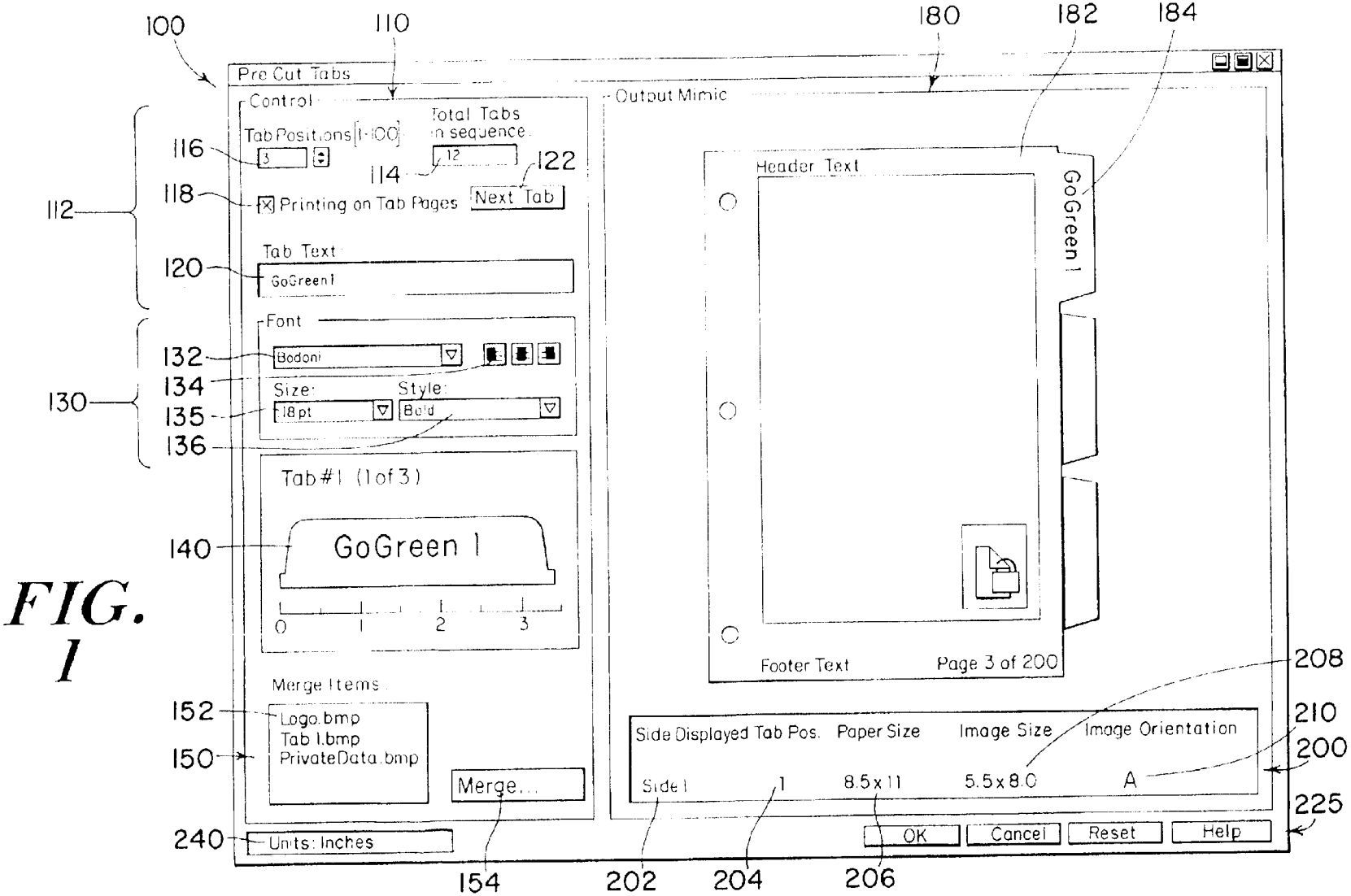
FIG. 1 provides an exemplary view of a user interface window according to an illustrated embodiment of the invention.

According to an illustrated embodiment of the invention, a user interface window 100 is provided as shown in FIG. 1. The user interface window 100 includes a control frame 110 and a page preview frame 180.

The control frame 110 includes a tab data entry portion 112. The tab data entry portion 112 includes a total tabs in sequence data entry field 114 for recording a total number of tabs in a document being processed. A tab positions data entry field 116 is provided to record the tab modulus, e.g. the number of unique tab positions. In the example shown in FIG. 1, the tab positions data entry field 116 indicates three tab positions. Similarly, the page preview frame 180 graphically shows a set of precut tabbed pages having three tab positions.

A printing on tab pages data entry field 118 is also provided in the tab data entry portion 112. The printing on tab pages data entry field 118 is preferably a binary data entry field. If a user wishes to print on the tabs of the precut tabbed pages, the printing on tab pages data entry field 118 should be checked. Alternatively, if the user does not wish to print on the tabs of precut tabbed pages, the printing on tab pages data entry field 118 should be unchecked.

A tab text data entry field 120 is provided for entry of tab content text the user wishes to have on a particular tab of a precut tabbed page. The tab data entry portion 112 also includes a next tab button 122 to advance to a next tab. By way of example, if a first tab were active within the control frame 110, the user clicks on the next tab button 122 to allow for entry of tab text in the tab text data entry field 120 on a second tab.

In addition to text, tab content may also include graphics, either alone or in combination with text. Furthermore, tab content may be monochrome or multicolor.

A font data entry portion 130 is also provided within the control frame 110. The font data entry portion includes a font name data entry field 132. The font name data entry field 132 preferably is facilitated by the use of a dropdown selection list as shown in FIG. 1. Further font controls are provided within the font data entry portion 130, such as a font justification selection 134. As shown in FIG. 1, the font justification selection is provided by multiple pushbuttons, allowing a user to select among left justification, center justification or right justification. Optionally, a selection for full justification may be included within the font justification selection 134.

A font size data entry field 136 is also provided within the font data entry portion 130. As shown in FIG. 1, the font size data entry field 135 is preferably facilitated by the use of a dropdown selection list. Preferably, a user is alternatively able to directly key in, by the use of a numeric keypad or the like, a desired font size into the font size data entry field 135. A font style data entry field 136 is also preferably provided within the font data entry portion 130. As shown in FIG. 1, the font style data entry field 136 is preferably facilitated by the use of a dropdown selection list.

A tab preview frame 140 is preferably provided within the control frame 110. The tab preview frame 140 preferably provides information pertaining to the tab currently active within the control frame 110. For example, as shown in FIG. 1, the tab number is shown along an upper portion of the tab preview frame 140. Preferably, as shown in FIG. 1, a graphical representation of the active tab within the control frame 110 is shown along with the desired tab text. Furthermore, a scale is preferably shown below the graphically represented tab. As shown in FIG. 1, the tab currently active within the control frame 110 is approximately 3½ inches in length.

A merge field frame 150 is also preferably provided within control frame 110. The merge field frame 150 includes a listing of merge items 152 available for insertion within the tab text data entry field 120. A merge button 154 is also provided within the merge field frame 150. Upon clicking of the merge button 154, a merge item selected from the listing of merge items 152 is inserted within the tab text data entry field 120 at the location of a cursor within the tab text data entry field 120.

The page preview frame 180 is preferably provided within the user interface window 100 to show a graphical representation of the precut tabbed page corresponding to the active tab in the control frame 110. Preferably, other precut tabbed pages following the precut tabbed page corresponding to the active tab in the control frame 110 will also be shown within the page preview frame 180.

In accordance with the illustrated embodiment of the invention, tab content, such as tab text and any graphical elements are also shown, properly aligned on the tabs of the precut tabbed pages shown within the page preview frame 180.

Preferably, the invention includes graphical displays that are What You See Is What You Get (WYSIWYG) and therefore display an accurate representation of what will be included in the document.

By way of example, as illustrated in FIG. 1, a precut tabbed page 182 corresponding to an active tab in the control frame 110 is shown within the page preview frame 180. Tab content 184 is also shown in the page preview frame 180. In the present example, the tab content 184 consists of the text "GoGreen 1". The tab content 184 is properly rotated so as to be located on the tab of the precut tabbed page 182 and centered on the tab as specified in the font justification selection 134. The font characteristics and location of the tab content 184 are automatically determined in accordance with the user entered information in the control frame 110.

The precut tabbed page 182 may further include headers, footers, page numbering and additional text or graphics located anywhere on the precut tabbed page 182 as specified by the user. Samples of text and images relating to such entries are shown in FIG. 1.

The page preview frame 180, according to the illustrated embodiment of the invention, further includes a page detail portion 200. The page detail portion 200 preferably includes information relating to the presently displayed precut tabbed page 182. Examples of such information include the side displayed 202, the tab position 204, paper size 206, image size 208 and image orientation 210. The paper size 206 typically refers to the paper size of the precut tabbed page 182 without measurement of the tab of the precut tabbed page 182.

The user interface window 100 further includes operation buttons 225. The operation buttons 225 typically include buttons corresponding to each of: OK, Cancel, Reset and Help. Functions corresponding to each of these buttons are known to one of skill in the art and allow the user interface window 100 to respond in accordance with the expectations of a typical user.

A unit display 240 is also preferably provided in the user interface window 100 in accordance with the illustrated embodiment. The unit display 240 is preferably configured to display the dimensional units used within the user interface window 100. Such units are used, for example, within the tab preview frame 140 and the page detail portion 200 of the user interface window 100.

In operation, the illustrated embodiment of the present invention preferably allows the user to enter information relating to each precut tabbed page and corresponding tab content information to be entered for all precut tabbed pages and corresponding tabs either at one time or to be entered during processing of a document at the time the tabbed page is to be inserted within the document.

The invention optionally includes the ability to receive a location of a precut tabbed page within the document, such as by a page number, allowing for automated insertion of tabbed pages. Alternatively, the user interface window 100 prompts the user for information relating to the appropriate precut tabbed page at the time of processing of the precut tabbed page within the document.

Optionally, it is also within the scope of the invention to automatically compensate for deleted or additional precut tabbed pages. In the event a precut tabbed page is deleted, all precut tabbed pages following the deleted precut tabbed page are reconfigured so as to properly correspond to a new tabbed position. Therefore, no precut tabbed pages are discarded from within the tab sequence. Similarly, precut tabbed pages added between other precut tabbed pages within the document are accommodated by reconfiguring all precut tabbed pages following the additional precut tabbed page so as to properly correspond to a new tabbed position. Therefore, the tab positions remain in order, without interruptions to the repeating pattern of tab positions.

Preferably, the present invention digitizes the tab content for precise rotation and placement of the tab content onto the tab of the precut tabbed page 182.

Figure 2:
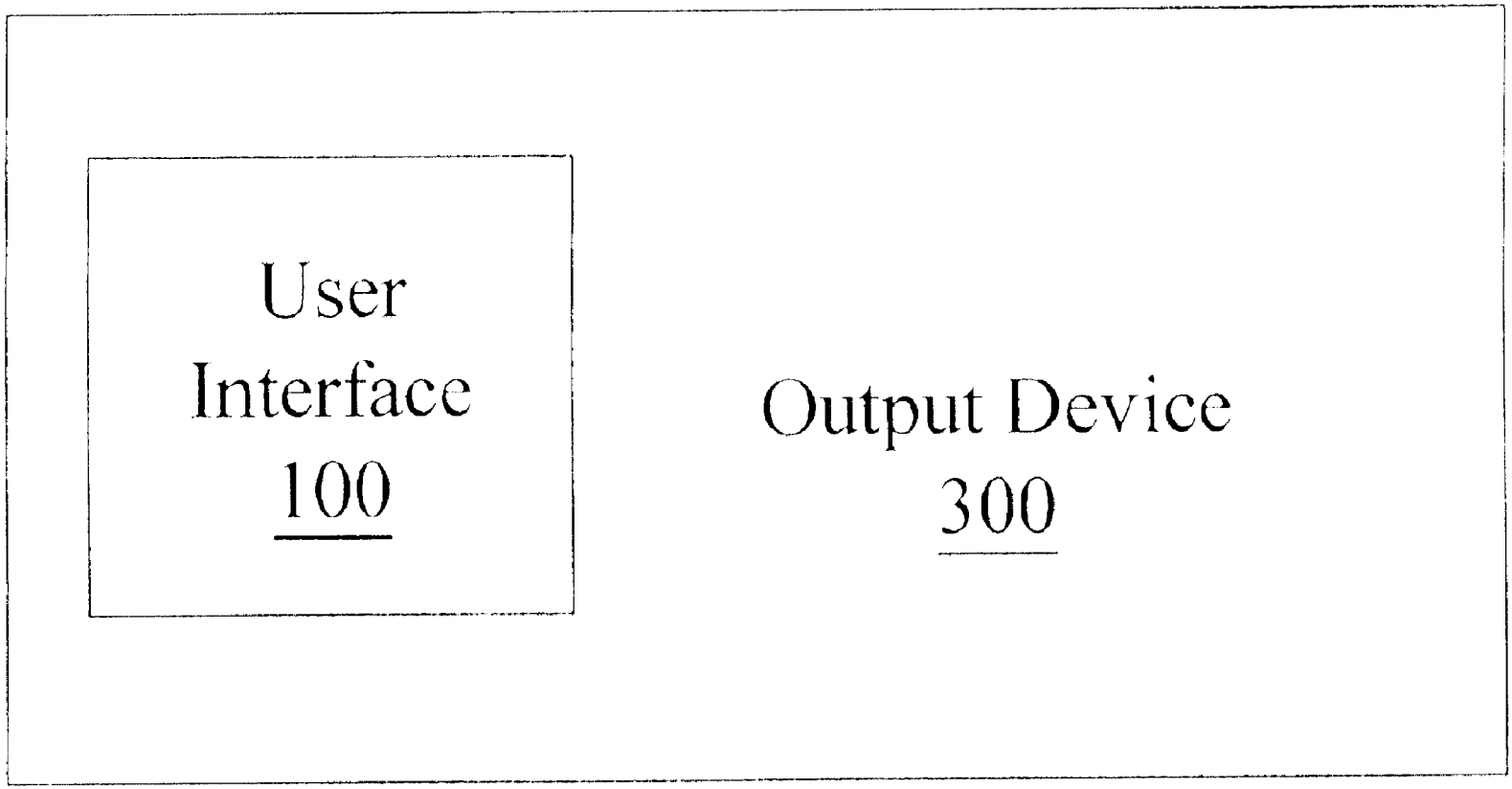
FIG. 2 is a schematic illustration of a document processing system according to an embodiment of the present invention.

As shown in FIG. 2, according to another embodiment of the invention, a document processing system is provided in which the user interface window 100 of the present invention may be integrated within an output device 300, such as a copier, printer or a combination copy/print device. Preferably, the user interface window 100 is one of a plurality of windows that can be accommodated within a display within the output device 300 upon indication by the user that precut tabbed pages will be included in the document. Preferably, a microprocessor is running on the output device 300 to display the user interface window 100 and adjust settings in response to choices made via the user interface window 100.

Figure 3:
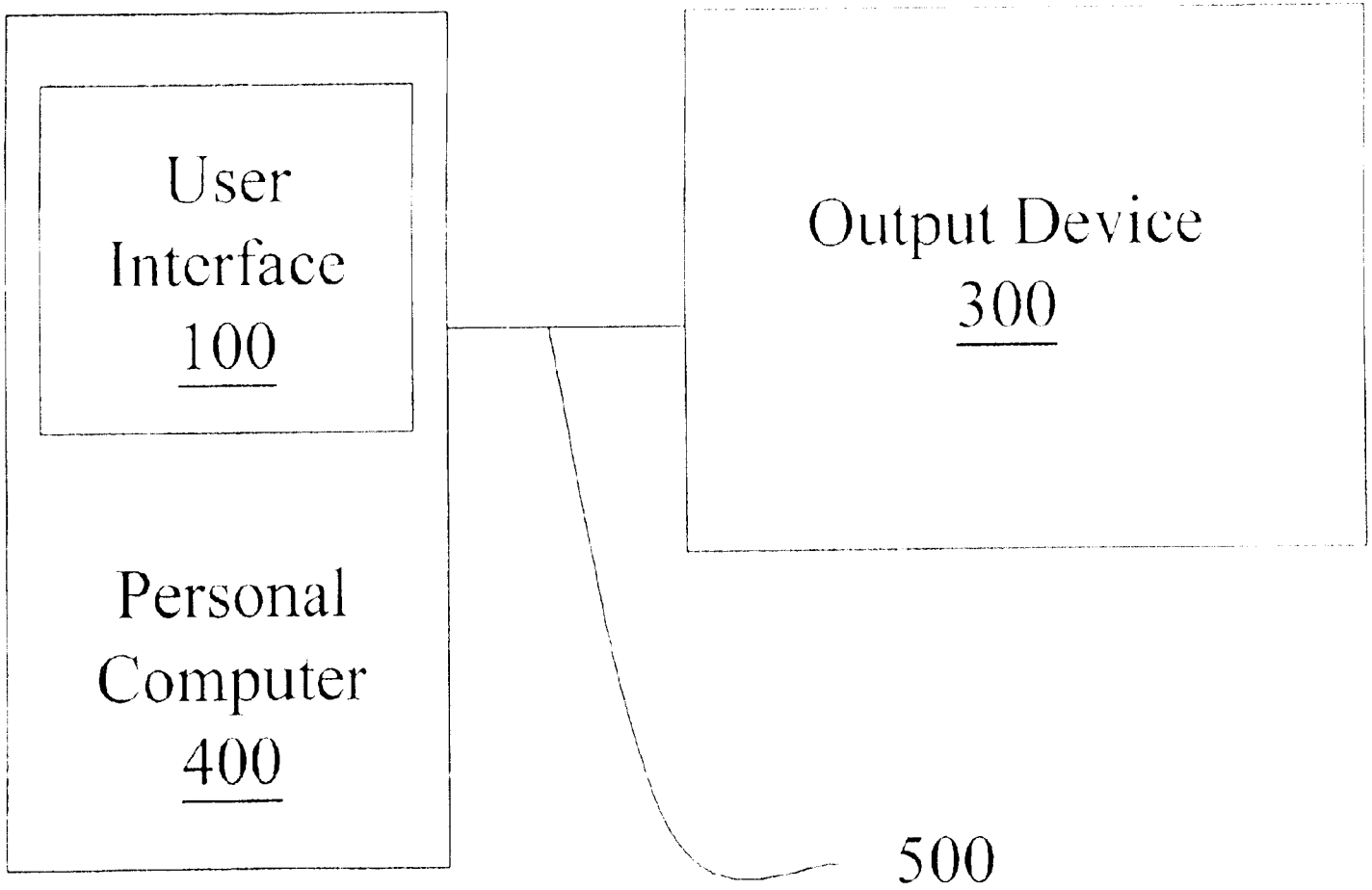
FIG. 3 is a schematic illustration of a variation of the document processing system according to an embodiment of the present invention.

According to a further embodiment of the invention, the document processing system of the present invention may involve the user interface of the present invention configured externally to the output device. For example, the user interface window 100 of the present invention may be accommodated on a personal computer 400 connected directly to the output device 300. Alternatively, as shown in FIG. 3, a network 500, such as a local area network or other form of network, such as the Internet, may be used to connect the personal computer to the output device. Preferably, a microprocessor is running on the personal computer 400 to display the user interface window 100 and adjust settings in response to choices made via the user interface window 100.

Figure 4:
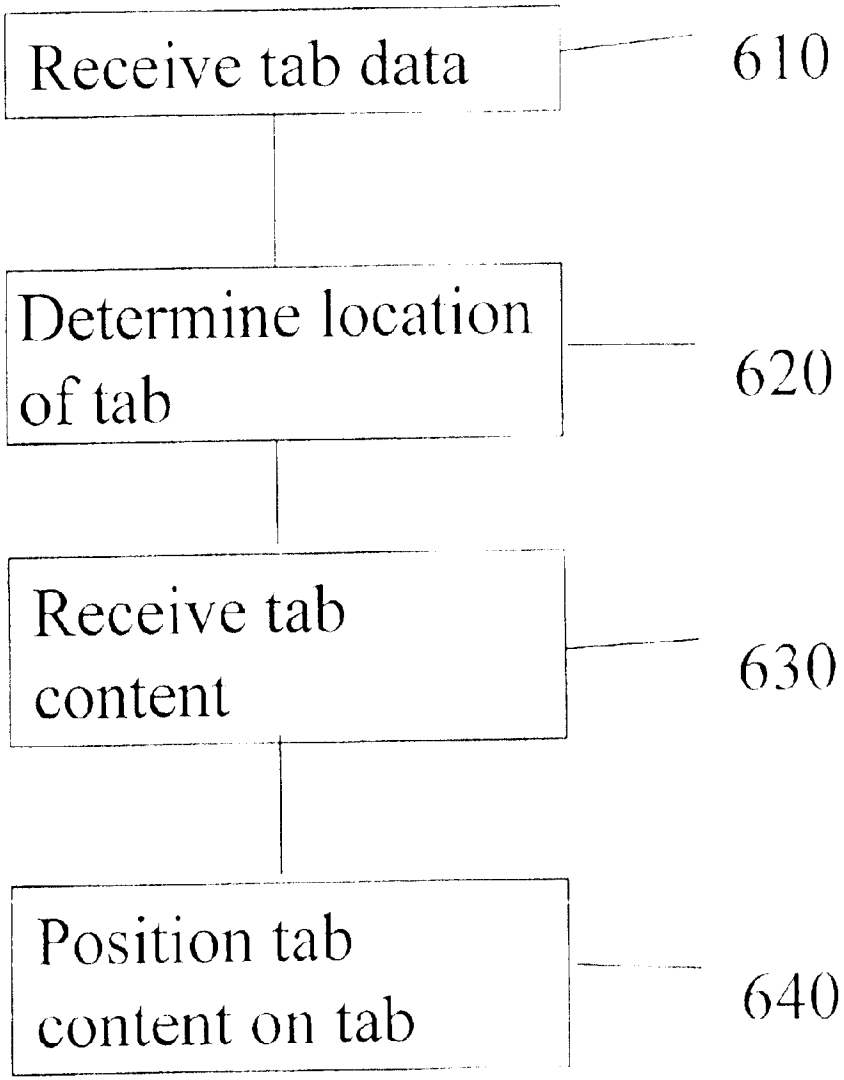
FIG. 4 is a flowchart of a method for processing a document according to a further embodiment of the present invention.

Another embodiment of the invention involves a method for processing a document having tabbed pages. As shown in FIG. 4, the method includes receiving tab data, such as tab modulus data, step 610. A location of a tab on the tabbed page is determined, step 620. Tab content is received, step 630, and tab content is positioned on the tab, step 640. Optionally, the tab content may be rotated during positioning on the tab. These steps are not required to happen in the listed order. For example, tab content may be received first, before receiving tab data, or determining a location of the tab.

Optionally, the tabbed pages may be automatically inserted in the document during processing. Tab data and tab content may be received in advance of the processing of the document, or may be received during processing of the document. For example, document processing could be halted at the time of insertion of a tabbed page to allow the user to input tab content or tab data for the tabbed page to be inserted.

These examples are meant to be illustrative and not limiting. As described herein, the terms positioning mechanism and adjustment mechanism are considered to be interchangeable.

The present invention has been described by way of example, and modifications and variations of the exemplary embodiments will suggest themselves to skilled artisans in this field without departing from the spirit of the invention. Features and characteristics of the above-described embodiments may be used in combination.

The preferred embodiments are merely illustrative and should not be considered restrictive in any way. The scope of the invention is to be measured by the appended claims, rather than the preceding description, and all variations and equivalents that fall within the range of the claims are intended to be embraced therein.

Having described the invention, what is claimed as new and protected by Letters Patent is:

1. A document processing system having a user interface for creating a plurality of tabbed pages within said document, each tabbed page carrying an individual tab, said user interface comprising:

an interactive tab data entry frame facilitating entry of tab data by an operator, including a total number of said tabbed pages in said document and a number of unique tab positions to format said tabbed pages, and entry of tab content for each associated tab by the operator; and a page preview frame showing a layout of the unique tab positions for formatted tabbed pages and said tab content entered by the operator for each associated tab, which tab data entry frame and page preview frame are simultaneously displayed on the same screen and wherein the page preview frame is dynamically updated in response to the entry of the tab data into the tab data entry frame.

2. The document processing system of claim 1, wherein said user interface allows all of said tab data and tab content to be entered at one time.

3. The document processing system of claim 1, wherein said user interface allows said tab content to be entered during creation of a document.

4. The document processing system of claim 1, wherein said page preview frame shows an accurate contemporaneous image of said tabbed page with said tab content.

5. The document processing system of claim 1, wherein said page preview frame shows an accurate image of a plurality of said tabbed pages with a corresponding plurality of said tab content.

6. The document processing system of claim 1, wherein said user interface is adapted to receive data pertaining to a location of said tabbed pages in a document to allow for automated insertion of said tabbed pages.

7. The document processing system of claim 1, wherein said tab content comprises a graphic.

8. The document processing system of claim 7, wherein said graphic is a color graphic.

9. The document processing system of claim 1, wherein said user interface is adapted to compensate for deleted tabbed pages.

10. The document processing system of claim 1, wherein said user interface is adapted to automatically accommodate a change in tab data involving a change in tab modulus.

11. The document processing system of claim 1, wherein said user interface is adapted to digitize tab content.

12. The document processing system of claim 1, wherein said user interface is adapted to justify tab content on said tab.

13. The document processing system of claim 1, wherein a personal computer hosts said user interface.

14. A document processing system having a user interface for creating a plurality of tabbed pages within the document, each tabbed page carrying an individual tab, the user interlace comprising:

a tab data entry frame facilitating entry of tab data, including a total number of the tabbed pages in the document and a number of unique tab positions to format the tabbed pages, and entry of tab content for each associated tab which tab content includes merged fields; and a page preview frame showing a layout of the unique tab positions for the formatted tabbed pages and the tab content entered for each associated tab, which tab data entry frame and page preview frame are simultaneously displayed on the same screen and wherein the page preview frame is dynamically updated in response to the entry of the tab data into the tab data entry frame.

15. An automated method for processing a document having tabbed pages, said method comprising the steps of:

entering by an operator tab modulus data including a number of unique tab positions into a tab data entry frame;

receiving entered tab modulus data;

determining a location of a tab on each of said tabbed pages based on received modulus data;

receiving tab content;

positioning tab content onto said tab;

simultaneously displaying on the same screen a page preview frame and the tab data entry frame; and dynamically updating the page preview frame in response to the entry of the tab modulus data.

16. The method for processing a document having tabbed pages of claim 15, wherein said step of positioning tab content involves rotating said tab content for placement on said tab.

17. The method for processing a document having tabbed pages of claim 15, further comprising the steps of:

receiving data identifying a location of at least one of said tabbed pages in said document; and automatically inserting said at least one of said tabbed pages in said document.

* * * * *